United States Patent [19]

Karn

[11] Patent Number: 4,998,144

[45] Date of Patent: Mar. 5, 1991

[54] COLOR PALETTE FOR COPIERS

[75] Inventor: Keith S. Karn, Rochester, N.Y.

[73] Assignee: Eastman Kodak Company, Rochester, N.Y.

[21] Appl. No.: 456,878

[22] Filed: Dec. 26, 1989

[51] Int. Cl.[5] ..... G03G 15/01

[52] U.S. Cl. ..... 355/326

[58] Field of Search ..... 355/328, 326, 327, 218; 358/75, 75 IJ, 76, 77, 78, 79, 80

[56] References Cited

U.S. PATENT DOCUMENTS

| | | | |
|---|---|---|---|
| 4,045,218 | 8/1977 | McVeigh | 430/45 |
| 4,771,314 | 9/1988 | Parker et al. | 355/328 |
| 4,777,510 | 10/1988 | Russel | 355/328 |
| 4,791,450 | 12/1988 | Masehauer et al. | 355/328 |
| 4,862,217 | 8/1989 | Russel | 355/328 X |
| 4,868,611 | 9/1989 | Germain | 355/328 |

FOREIGN PATENT DOCUMENTS

| | | | |
|---|---|---|---|
| 3835239A1 | 4/1989 | Fed. Rep. of Germany . | |
| 0070564 | 4/1986 | Japan | 355/328 |
| 0291674 | 12/1987 | Japan | 355/328 |

*Primary Examiner*—A. T. Grimley
*Assistant Examiner*—Sandra L. Hoffman
*Attorney, Agent, or Firm*—Milton S. Sales

[57] ABSTRACT

A color copier is adapted to receive a color palette visually representing a plurality of colors selectably by an operator for portions of reproductions. A portion of the reproduction is formed in a selected color, based on a supplied series of electrical data signals. An operator interface provides for selecting at least one of a plurality of colors visually displayed on a received color palette. A series of electrical data signals, which is representative of the pattern and color image content of a color palette is stored, and can be applied to create a color palette using the same image forming apparatus as is used to produce copies.

6 Claims, 5 Drawing Sheets

COLOR PALETTE FOR COPIERS

BACKGROUND OF THE INVENTION

1. Technical Field

This invention relates generally to multicolor document copiers, and more specifically to the provision of a color palette from which colors can be operator selected.

2. Background Art

U.S. Pat. No. 4,045,218 discloses an electrophotographic copier adapted to produce reproductions from single color originals such that selected portions of the image are reproduced in a second color toner contained in a second development station. U.S. Pat. No. 4,791,450 teaches an improvement wherein color selection may be made from a menu of many different colors, say for example 25 different colors, without providing significantly more color development stations. This is of course effected in a color copier using subtractive colored toners of cyan, magenta, yellow, and black in various combinations to produce different colors.

In copiers adapted to produce only a very few colors, the accuracy of the color reproduction is not considered to be very critical. An operator who wants part of the image to stand out from the rest probably does not care what shade of red, blue, or other color is used. Color selection may be made from a short word list of colors, or from a color image of those few colors available. If the latter, experience shows that operators are not disappointed if the reproduced color does not closely match the illustrated color.

On the other hand, when many colors are offered, it becomes difficult if not impossible to describe the colors by words. Therefore, color palettes have been employed to show an operator the color options available. But this practice presents a problem. When there are many closely related colors available, operators tend to be more critical of differences between the reproduced color and the color selected from the palette.

Differences between the color shown on the palette and the actual color produced may result from differences between the color ink used to produce the palette and the color toner or ink used to make the copy. Further, the actual color produced can vary from time to time due to photoconductor fatigue, changes in machine environment (temperature and relative humidity), improper adjustment, etc. Accordingly, any palette which correctly represented colors under one set of conditions would not necessarily be correct under another set of conditions.

DISCLOSURE OF INVENTION

It is an object of the present invention to provide multicolor document copiers with a color palette from which selected colors can be more accurately and reliably previewed by an operator.

It is another object of the present invention to provide such copiers with the capacity to produce a color palette wherein the colors on the palette accurately reflect the colors producable by the copier.

It is yet another object of the present invention to provide such a copier with a simple and inexpensive capacity to produce such color palettes.

In accordance with a feature of the present invention, a color copier which is adapted to receive a color palette visually representing a plurality of colors selectable by an operator for portions of reproductions, includes image forming means for forming a reproduction on a receiver, including forming a portion of the reproduction in a selected color, based on a supplied series of electrical data signals. An operator interface includes means for selecting at least one of a plurality of colors visually displayed on a received color palette. Memory means is provided for storing a series of electrical data signals representative of the pattern and color image content of a color palette which, when created, visually represents a plurality of colors selectable by an operator for portions of reproductions, and for applying the stored electrical signals to the image forming means to create a color palette using the same image forming means as is used to produce copies.

In a preferred embodiment of the present invention, the image forming means further includes means for designating a portion of the image to be copied, accent color means for forming the designated portion of the copied image in a selected color, highlighting means for forming the background of the designated portion of the copied image in a selected color, and color substitution means for replacing a designated color with a selected color. The memory means further comprises means for storing a color separation bit map for each of the plurality of colors. The color separation bit maps may be stored in compressed form.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present invention is described herein as part of an electrophotographic copier, but it will be understood that the invention can be used in any form of color copier. The description will be directed in particular to elements forming part of, or cooperating more directly with, apparatus in accordance with the present invention. It is to be understood that elements not specifically shown or described may take various forms well known to those skilled in the art.

Figure 1:
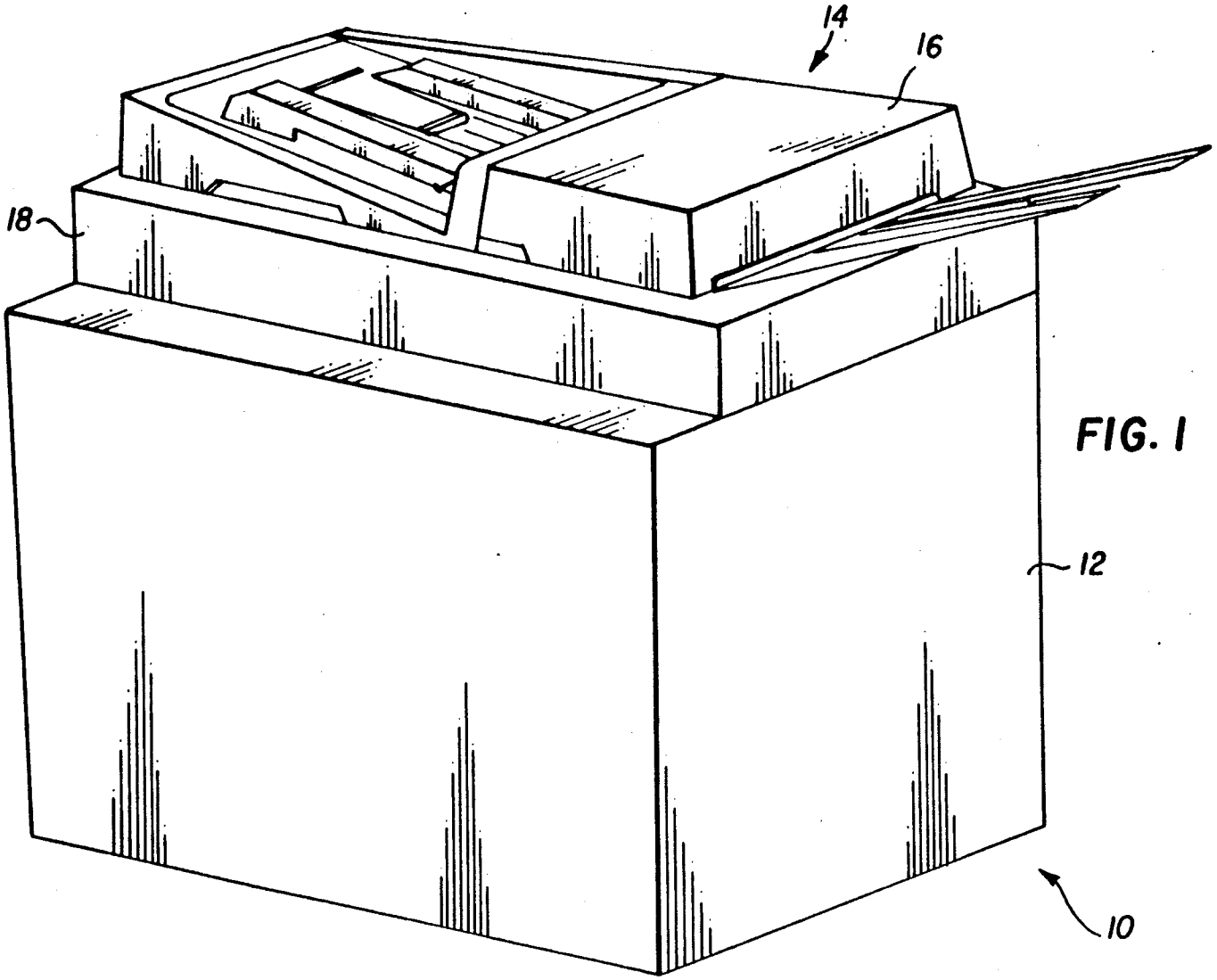
FIG. 1 is a perspective view of reproduction apparatus according to the present invention.
Figure 2:
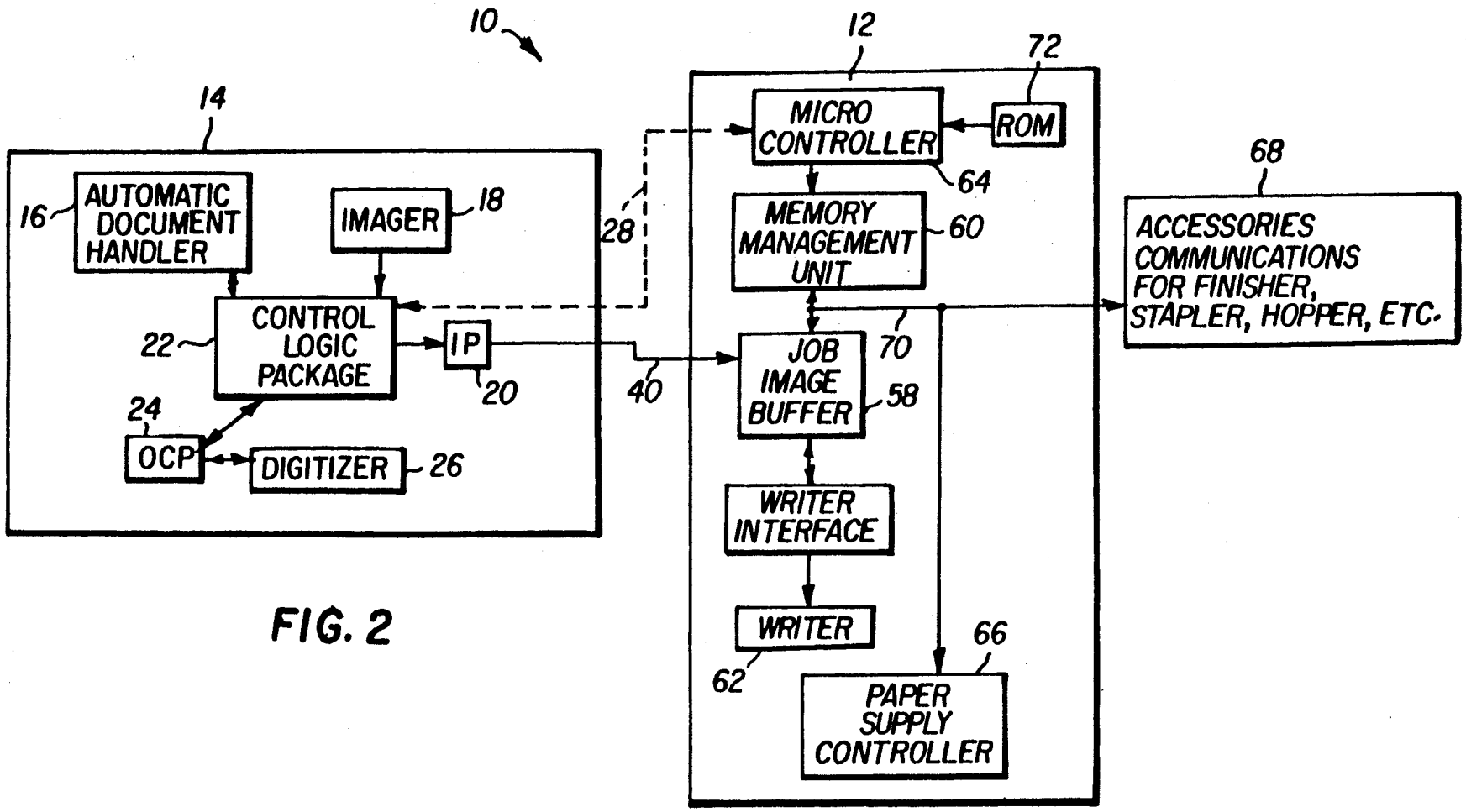
FIG. 2 is a schematic block diagram of reproduction apparatus of FIG. 1.

According to FIGS. 1 and 2, a copier 10 includes a marking engine 12 and a document scanner 14. Scanner 14 consists of an automatic document handler 16 for stream feeding multiple hard copy original documents past an optical system enclosed in an optics housing 18. Focused light reflected from an original document image is swept past an imager 18 such as a linear array of phototransducers, (photodiodes or charge coupled devices) for converting the image of an original document into electrical signals having values representative of the image density at associated pixel areas on the original document.

As the scanning of the original document proceeds in a direction perpendicular to the row of pixel areas, a series of output signals from the transducers are repetitively loaded into an associated shift register (not shown) and shifted out serially to provide a series of electrical signals having values representative of the image density of respective pixel areas in corresponding rows of pixel areas across the document image.

The image data may be manipulated by image processing electronics 20. Among other image processing functions such as linearity correction, unsharp masking, image editing, windowing, document recognition, and magnification, the image processing electronics is capable of adding selected colors to the reproduced image. For example, a selected color may be chosen for all of the image in a designated portion of the original; and this is referred to herein as "accent color." As another example, a selected color may be chosen for the background in a designated portion of the original; and this is referred to herein as "highlighting." As yet another example, a selected color may be chosen to replace only a designated color wherever the designated color appears in a designated portion of the original; and this is referred to herein as "color substitution."

Scanner 14 also includes a control logic package 22 having an operator control panel 24 and a digitizer 26. The operator control panel and the digitizer are interfacing media for the operator to input functions and to receive messages from the copier. The logic package consists of control software, interface software, and logic hardware. Setup instructions are input to the scanner, while synchronization signals to identify separate scan lines and to provide page information and marking engine control, as well as information for finishing and processing of jobs, will be sent to marking engine 12 via a job control communications link 28.

As way of example only, functions inputted by the operator at the control panel may include image editing features such as area erase (blanking and framing), image shift, book copy modes, magnification, positive-to-negative image reversal, accent (spot) color, highlighting, color substitution, forms overlay, screening selected areas for breaking a continuous tone original into dots for reproduction as half-tone images, etc.

Figure 3:
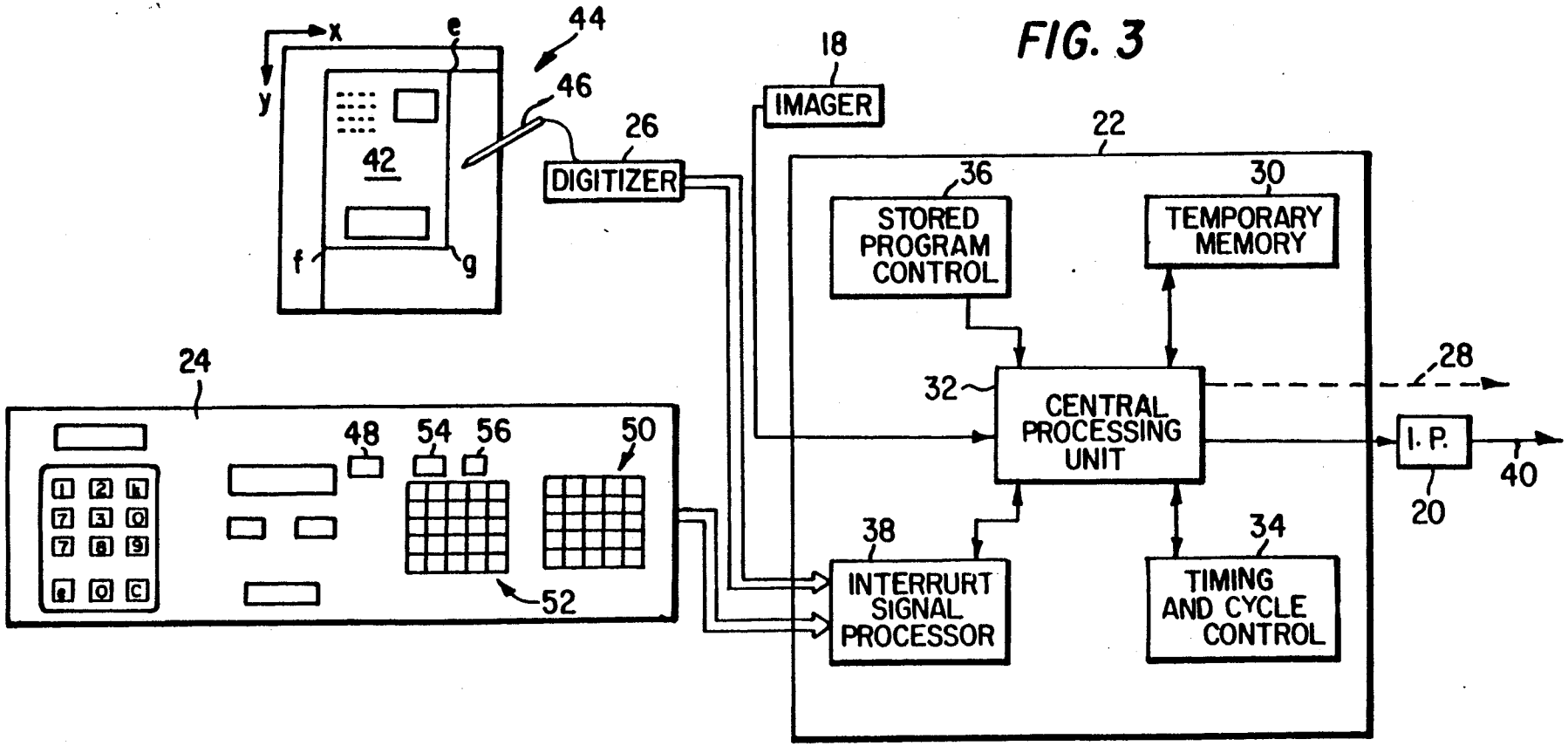
FIG. 3 is a schematic illustrating a data input station and block diagrams of controls for controlling the apparatus of FIGS. 1 and 2.

FIG. 3 is a block diagram of control logic package 22. The control logic package consists of temporary data storage memory 30, central processing unit 32, timing and cycle control unit 34, and stored program control 36. Data input and output is performed sequentially under program control. Input data are received from image imager 18, and control signals are received from operator control panel 24 and digitizer 26 through an interrupt signal processor 38 derived from various switches, sensors, and analog-to-digital converters. The output data is applied through processing electronics 20 and an image data bus 40, and control signals are applied via control communication link 28, to marking engine 12.

Digitizer 26 may take any of several well known forms such as the digitizing tablet disclosed in U.S. Pat. No. 4,791,450, wherein an original 42 is placed face up on a tablet 44. A wand 46 associated with the tablet is used by the operator to designate various positions on the original. Transducers located beneath the original produce signals relating the position of the positions touched relative to an edge of the tablet. Alternatively, the tablet may be of the known sonic type wherein a spark formed by a wand creates sound waves in the air which are sensed by microphones placed along the sides of the tablet or wherein a sensor is placed in the wand and sources at known points on the sides of the tablet emit sonic signals.

Figure 4:
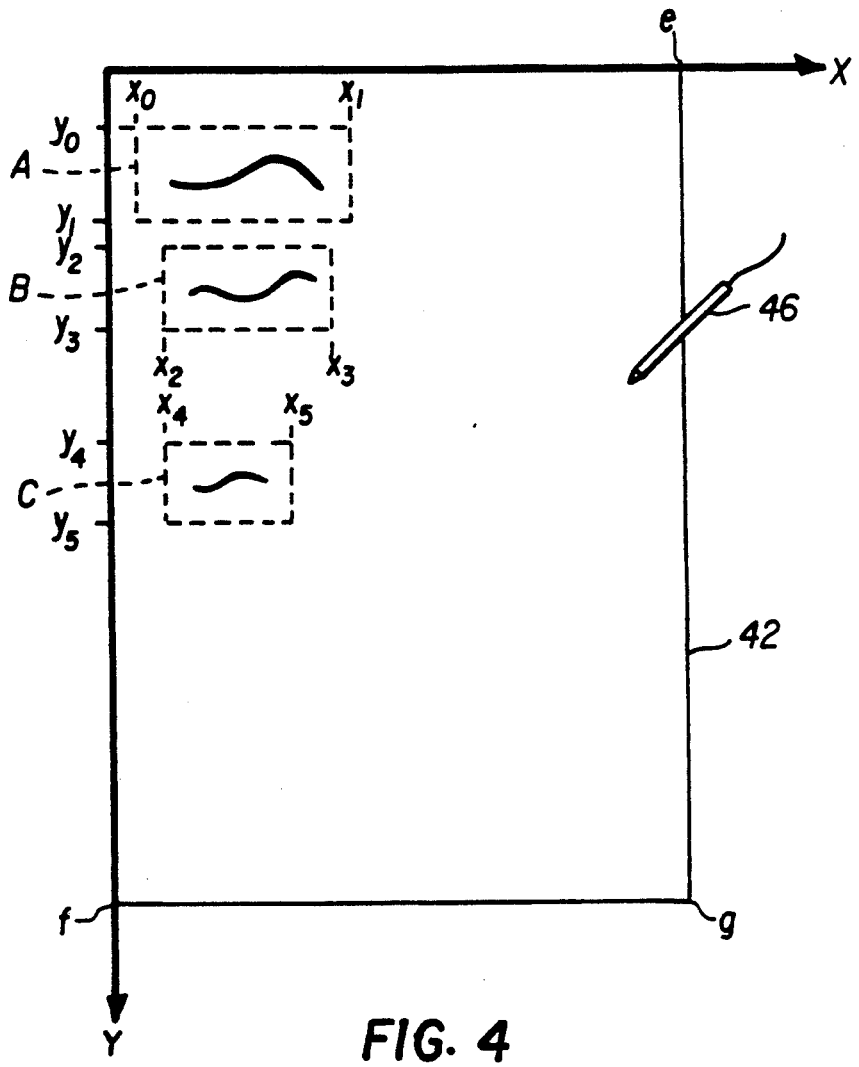
FIG. 4 is an illustration of a document that is to be reproduced with selected colors.

In order to reproduce a document sheet such as document sheet 42 (see FIG. 4) having composite information comprised of line-type information in areas A, B and C, the document sheet 42 is placed face up on digitizing tablet 44 and registered against an appropriate corner (or centered relative to a predetermined edge). Wand 46 is used by the operator to designate the format of the original and the locations of the various parts of the image information. Assuming that the operator wishes to reproduce black line-type information in area A on the original in red, to highlight in yellow the text in area B, and to substitute a particular shade of green to any portion of the image of area C which is red in the original, the operator calls up special programs for accomplishing these tasks via operator control panel inputs.

Next, the operator inputs the desired accent color for the information appearing in area A by depressing an accent input button 48 and the one of the twenty-five color buttons 50 corresponding to a selected color from a palette 52 of available colors. The operator then moves wand 46 to two or more points to define an imaginary rectangle or other area which encloses the information in area A and encloses no other information.

The operator then proceeds to input the desired highlight color for the information appearing in area B by depressing a highlight input button 54 and the one of the twenty-five color buttons 50 corresponding to a selected color (yellow) from palette 52 of available colors. The operator then uses wand 46 to identify area B.

Next, the operator proceeds to input the desired substitution color for the information appearing in area C by depressing a color substitution button 56 and touching a pixel on the original document which is of the color to be substituted for. Finally, the operator depresses the one of the twenty-five color buttons 50 corresponding to a selected substitution color from palette 52 of available colors, and uses wand 46 to identify area C.

Inputs from the digitizer and the color select buttons are inputted into control logic package 22 through interrupt signal processor 38 and are stored in temporary memory 30.

The operator next takes the original document 42 and places it on the exposure platen (using document handler 16 for example) so that the side to be reproduced faces the exposure lamps and registers the sheet with the appropriate corner (or centers it against a registration edge). The stored program control on the control logic package has a program for compensating for the reversal of the sheet vis-a-vis the location of areas when the sheet is face-up versus the location of these areas when the sheet is turned over for exposure. Alternatively, format input may not be needed where the same point on the sheet is registered when the sheet is both face up and face down. For example, where the sheet is registered when face-up using centering of its left edge for digitizing and then inverted for exposure so that the same edge is again centered, the location of the digitized areas is known without need of format input.

Referring again to FIG. 2, marking engine 12 receives bit stream image data over bus 40 and job control data over a communications link 28, both for storage in a multiple page buffer memory 58. The page buffer will accept electronic image data from scanner 14 and store that data until needed by a writer 60. The storage media is preferably a dynamic random access memory under the control of a memory management unit 62.

Control means, including a micro controller 64 is arranged to perform arithmetic and logic operations and instruction decoding as well as controlling the time allocation of peripherals (such as a paper supply controller 66 and accessories 68) through a machine control communications link 70. Several output functions may be available for receiver sheets, including selection of output trays, stapling, sorting, folding, finishing, mailbox, envelope receiver, etc.

Micro controller 64 has associated with it RAM for storing image location addresses and a read only memory 72 in which is stored various fixed forms such as test patterns, density patch patterns for process control purposes, billing forms, etc. One such form, according to a preferred embodiment of the present invention, is a set of color separation image bit maps which, when printed on a receiver sheet, produces a color chart or palette of the colors corresponding to color buttons 50 of FIG. 3. In one embodiment, the forms are stored in compressed form to be read into job image buffer 58 and then sent to the writer interface for decompression to produce a color palette. Alternatively, the forms may be stored in ROM in a form suitable for direct reading to the writer without decompression. This would require a larger memory, but would simplify the job handling requirements of memory management unit 60.

Figure 5:
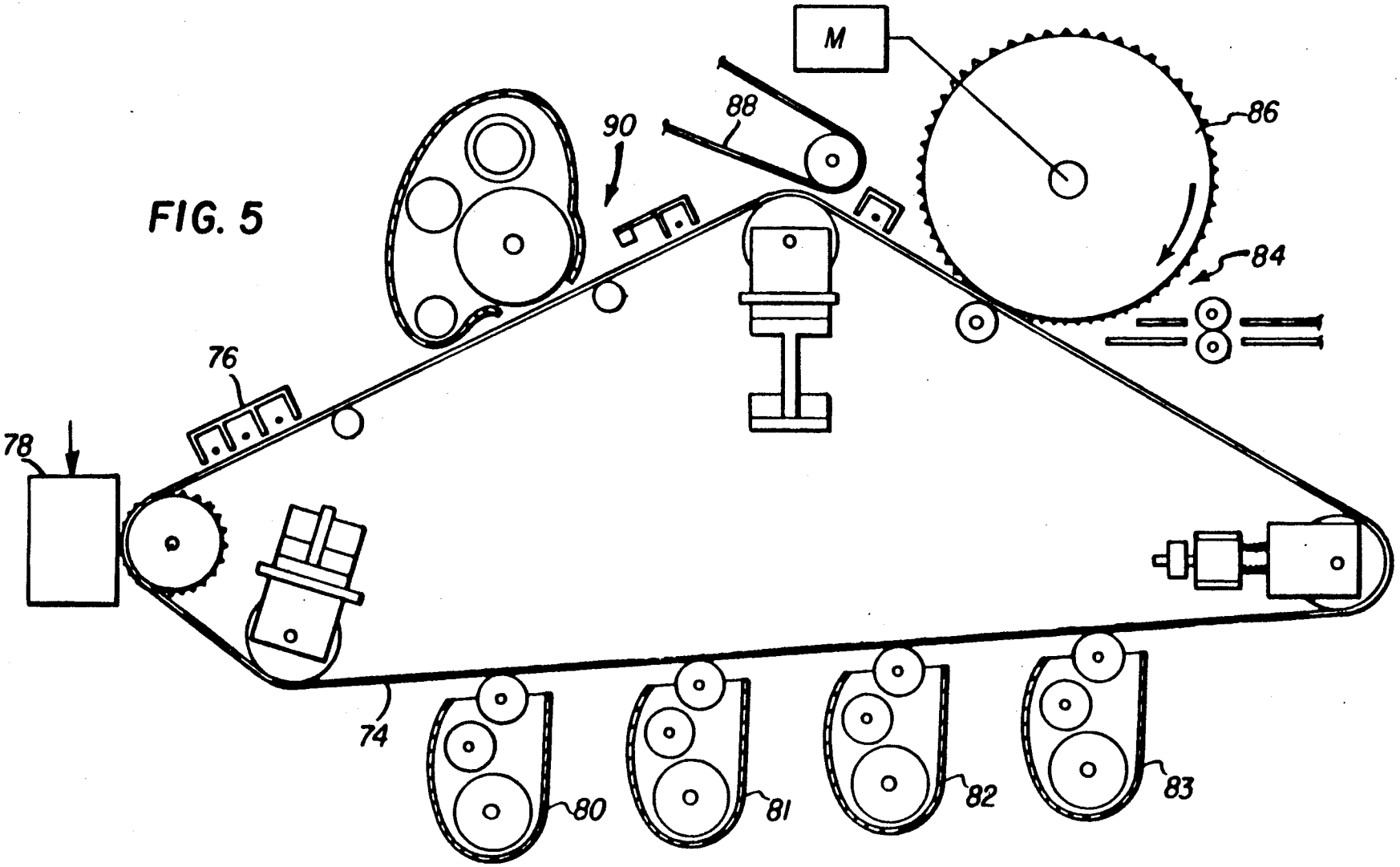
FIG. 5 is a schematic diagram of a multi-color electrostatographic reproduction apparatus.

Details of writer 62 are shown in FIG. 5. A film core portion of the writer includes an image bearing member, for example, an endless electrophotoconductive web 74 entrained about a series of primary rollers and other supporting structure. Web 74 is driven through a series of electrophotographic stations generally well-known in the art. More specifically, a uniform charge is laid down on the web by a charging station 76. The uniformly charged web moves around one of the rollers, which is directly opposite an LED printhead 78 which LED printhead exposes web 74 in a manner well-known in the art.

The web then moves into operative relation with a series of toning or developing stations 80, 81, 82 and 83. Each image created by printhead 78 is toned by one of the toning stations. The toner image then proceeds to a transfer station 84 where the image is transferred to a transfer surface of a receiver sheet carried by a transfer drum 86. The transfer drum cooperates with web 74 to incrementally bring the receiver sheet and the toner image into transfer relation so that the toner image is transferred to the receiver sheet.

As thoroughly discussed in U.S. Pat. No. 4,712,906, consecutive images in different colors are transferred in registry to a receiver sheet. The receiver sheet is wrapped on transfer drum 82 and recirculated on the surface of the drum into transfer relation with the consecutive images to create a multicolor image on the sheets. When the apparatus is operating in a multi-image mode, for example, a multicolor mode, consecutive images or pairs of images are toned with different colored toners using the different toning stations 80–83. These consecutive images are transferred in registry to the receiver sheet as it repeatedly is brought into transfer relation with web 74 by drum 86. After the transfer operation is complete, the receiver sheet is allowed to follow the web, and is separated from the web with the aid of an electrostatic sheet transport mechanism 88 and is transported to a fuser not shown. The web is then cleared by the application of a neutralizing corona and a neutralizing erase lamp and a magnetic brush cleaning mechanism all located at a cleaning station 90.

The invention has been described in detail with particular reference to preferred embodiments thereof, but it will be understood that variations and modifications can be effected within the spirit and scope of the invention.

What is claimed is:

1. A color copier adapted to generate and receive a color palette visually representing a plurality of colors selectable by an operator for portions of reproductions, said copier comprising:

image forming means for forming a reproduction of an original image, including forming a portion of the reproduction in a selected color, based on a supplied series of electrical data signals;

an operator interface including means for selecting at least one of a plurality of colors visually displayed on a received color palette; and memory means for storing a series of electrical data signals representative of the pattern and color image content of a color palette which, when created, visually represents a plurality of colors selectable by an operator for portions of reproductions, and for applying the stored electrical signals to said image forming means to create a color palette using the same image forming means as is used to reproduce original images.

2. A color copier as defined in claim 1 wherein said image forming means further comprises:

means for designating a portion of the original image; and accent color means for forming the designated portion of the reproduction in a selected color.

3. A color copier as defined in claim 1 wherein said image forming means further comprises:

means for designating a portion of the original image; and highlighting means for forming the background of the designated portion of the reproduction in a selected color.

4. A color copier as defined in claim 1 wherein said image forming means further comprises:

means for designating a color of the original image; and color substitution means for replacing the designated color with a selected color in the reproduction.

5. A color copier as defined in claim 1 wherein said memory means further comprises means for storing a color separation bit map for each of said plurality of colors.

6. A color copier as defined in claim 1 wherein said memory means further comprises means for storing a color separation bit map in compressed form for each said plurality of colors.

* * * * *